United States Patent [19]

Fujiwara

[11] Patent Number: 4,765,868

[45] **Date of Patent: * Aug. 23, 1988**

[54] FLOW RESTRAINING ELEMENTS IN THE HEADBOX OF A PAPER MACHINE

[75] Inventor: Haruyoshi Fujiwara, Mihara, Japan

[73] Assignee: Mitsubishi Jukogyo Jabushiki Kaisha, Tokyo, Japan

[ * ] Notice: The portion of the term of this patent subsequent to Aug. 5, 2003 has been disclaimed.

[21] Appl. No.: 662,817

[22] Filed: Oct. 22, 1984

Related U.S. Application Data

[63] Continuation of Ser. No. 484,694, Apr. 19, 1983, abandoned, which is a continuation of Ser. No. 287,548, Jul. 28, 1981, abandoned.

[30] Foreign Application Priority Data

Aug. 5, 1980 [JP] Japan ..... 55-107378
Nov. 20, 1980 [JP] Japan ..... 55-163936

[51] Int. Cl.[4] ..... D21F 1/02

[52] U.S. Cl. ..... 162/343; 162/344; 162/347

[58] Field of Search ..... 162/214, 216, 344, 347, 162/343, 336

[56] References Cited

U.S. PATENT DOCUMENTS

| | | | |
|---|---|---|---|
| 2,718,824 | 9/1955 | Hornbostel | 162/344 |
| 3,562,107 | 2/1971 | Schmaeng | 162/336 |
| 3,843,470 | 10/1974 | Betley et al. | 162/343 |
| 3,976,539 | 8/1976 | Kirjauaiunen | 162/347 |
| 4,021,296 | 5/1977 | Reiner | 162/347 |
| 4,104,116 | 8/1978 | Koskimies | 162/343 |
| 4,125,429 | 11/1978 | Hergert et al. | 162/343 |
| 4,141,789 | 2/1979 | Justus | 162/343 |
| 4,367,014 | 3/1983 | Bergstrom | 162/343 |
| 4,373,993 | 2/1983 | Fujiwara | 162/344 |
| 4,604,164 | 8/1986 | Fujiwara et al. | 162/343 |

FOREIGN PATENT DOCUMENTS

| | | | |
|---|---|---|---|
| 719080 | 10/1965 | Canada | 162/216 |

*Primary Examiner*—Steve Alvo
*Attorney, Agent, or Firm*—Wenderoth, Lind & Ponack

[57] ABSTRACT

A head box in a paper machine, characterized in that a flow path having a repeatedly and alternately narrowing and broadening cross-section configuration is formed within a slice chamber delimited by a top plate and a bottom plate converging towards a slip lip.

1 Claim, 5 Drawing Sheets

FLOW RESTRAINING ELEMENTS IN THE HEADBOX OF A PAPER MACHINE

This application is a continuation of now abandoned application Ser. No. 484,694, filed Apr. 19, 1983, now abandoned; which is a continuation of now abandoned application Ser. No. 287,548, filed July 28, 1981.

BACKGROUND OF THE INVENTION

The present invention relates to a head box in a paper machine.

Heretofore, a head box provided in a paper machine has been known, in which a raw paper liquid is passed through a slice chamber (2) to be ejected from an opening at a slice lip (1) as shown in cross-section in FIG. 1. The raw paper liquid is fed from a preslice chamber (3) through perforations (5) arrayed in a plurality of rows in a perforated plate (4), and enters into the slice chamber (2) which converges in cross-section towards the slice opening as delimited by a top plate (6) and a bottom plate (7). The inner space of the slice chamber (2) is partitioned by flow restraining elements (8) so that a turbulent flow for dispersing fibers may be generated by forming a plurality of restrained flow paths (9). Owing to a hydrodynamic effect of the raw paper liquid flow, the flow restraining elements (8) are held at the positions separated from each other (See Japanese Patent Publication No. 55-6564 (1980)).

FIG. 2 shows another structure of the slice chamber in the prior art, in which flow restraining elements (10) having corrugated surfaces are employed. The flow restraining elements of either configuration can generate a turbulent flow in the raw paper liquid flowing through the restrained flow paths (9) to disperse the fibers of paper.

However, the slice chambers in the head box in the prior art illustrated in FIGS. 1 and 2 had the following shortcoming. That is, although the prior art structures have their characteristic merit that vortexes generated on the upstream side would be quickly reduced in size as they move to the downstream due to the presence of the flow restraining elements and thereby the raw paper liquid can be stably ejected from the slice opening at a uniform rate along the widthwise direction, dispersion of the paper fibers was not sufficient and sometimes it was liable that paper having small flocks was produced.

In addition, in the case of containing long fibers, there exists a tendency that the fibers would align in the direction of the flow, resulting in largely different tensile strengths of the produced paper web between the longitudinal and lateral directions. In general, if a liquid is made to flow in a turbulent flow, vortexes are generated, and when a vortex is produced in the raw paper liquid, a difference in concentration would arise because paper fibers are moved outwardly of the vortex due to a centrifugal force. Furthermore, due to revolution in the vortex, the paper fibers would be subjected to twisting. Accordingly, dispersion of fibers by making use of a turbulent flow was difficult. The present invention has been proposed for the purpose of eliminating the above-mentioned shortcomings in the prior art.

OBJECTS AND SUMMARY OF THE INVENTION

It is therefore a principal object of the present invention to provide an improved head box in a paper machine which can improve dispersion of paper fibers, and which can improve a mechanical property of a paper web by enhancing the tensile strength in the widthwise direction of the paper web to such extent that the difference from the tensile strength in the lengthwise direction thereof, that is, in the direction of the flow of the raw paper liquid, may be minimized.

In order to achieve the above-mentioned object, the paper machine according to the present invention is characterized in that a flow path or paths of a raw paper liquid are formed having a cross-sectional area or areas repeatedly and gradually increased and decreased along the direction of the flow within a slice chamber delimited by a top plate and a bottom plate which converge towards a slice lip.

BRIEF DESCRIPTION OF THE DRAWINGS

The above-mentioned and other objects, features and advantages of the present invention will become more apparent by reference to the following description of preferred embodiments of the invention taken in conjunction with the accompanying drawings, wherein.

DETAILED DESCRIPTION OF THE PREFERRED EMBODIMENTS

Figure 1:
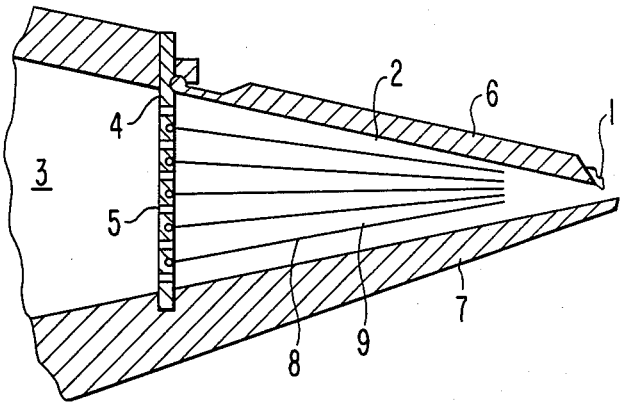
FIGS. 1 and 2 are longitudinal cross-section side views showing two different examples of a head box in a paper machine in the prior art, FIGS. 3(*a*), 3(*b*), 4, 5, 6, 7 and 8 are longitudinal cross-section side views showing various preferred embodiments of a head box in a paper machine according to the present invention.
Figure 2:
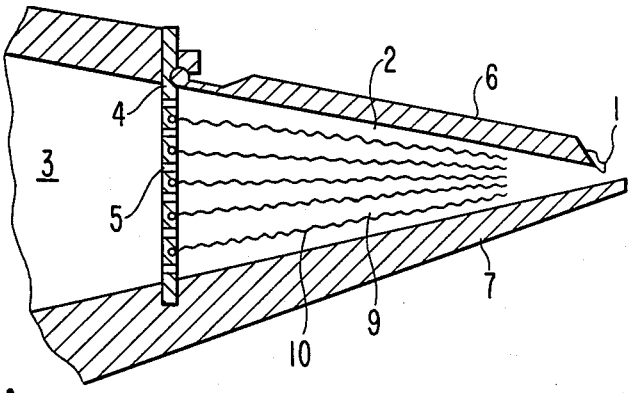
Figure 3A:
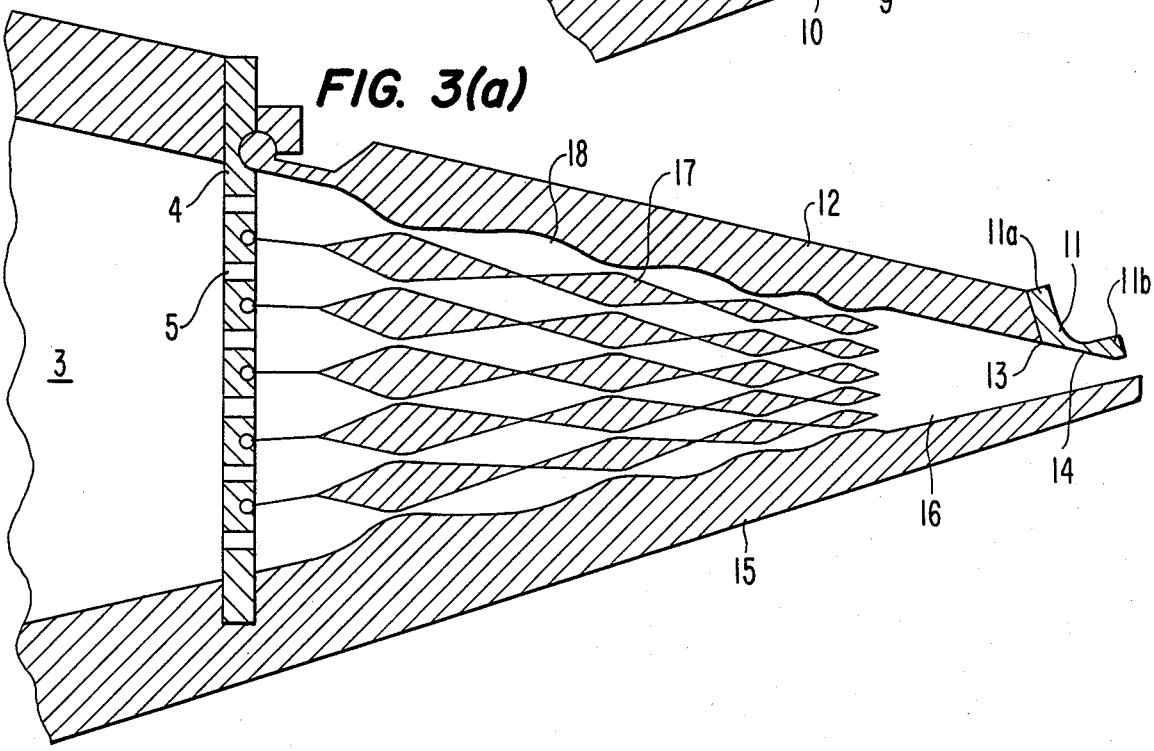
Figure 3B:
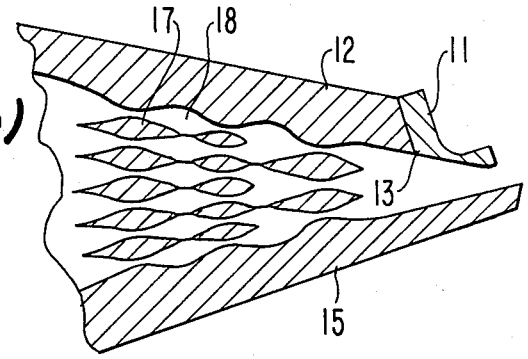

In the preferred embodiments of the present invention shown in FIGS. 3(*a*), 3(*b*) and 4, reference numeral (11) designates a slice lip, which is fixedly secured to a top plate (12) by means of bolts not shown, and the junction (13) between the slice lip (11) and the top plate (12) on the side of contacting a liquid is formed in a flush face. The slice lip (11) includes a neck portion (14) having a low rigidity between its mounting portion (11*a*) to be fixed to the top plate (12) and its tip end portion (11*b*). The slice lip (11) is adapted to be flexed at the neck portion (14) by manipulating a jacking rod (not shown) which is mounted to the tip end portion (11*b*) so as to broaden or narrow the gap distance between the tip end portion (11*b*) and a bottom plate (15) and thereby change the flow rate at the respective points along the widthwise direction of the slice lip opening for achieving fine adjustment of a profile of basic weight along the widthwise direction.

Reference numeral (16) designates a slice chamber delimited by top plate (12) and bottom plate (15) which converge towards slice lip (11), in which slice chamber are disposed flow restraining elements (17) extending towards the slide lip (11). The faces of the flow restraining elements (17) are formed of smooth surfaces which repeatedly and gradually approach and separate from the opposed faces of the adjacent flow restraining elements along the direction of flow of the raw paper liquid, as shown in FIGS. 3(*a*) and 3(*b*).

In the embodiments shown in FIGS. 3(*a*) and 3(*b*), the cross-section configurations of the flow restraining elements (17) are smoothly and gradually varied so as to repeatedly and alternately narrow and broaden the restrained flow paths (18) formed between the adjacent flow restraining elements (17), and the flow straining elements (17) as well as the restrained flow paths (18) converge as they approach the slice lip (11). In addition, the inner faces of the top plate (12) and the bottom plate (15) which contact the raw paper liquid are also wavy so as to match with the cross-section configurations of the flow restraining elements (17).

A modified embodiment in which the lengths of the flow restraining elements (17) illustrated in FIG. 3(*a*) are varied so that a plurality of restrained flow paths (18) may be joined together in a step-wise manner, is illustrated in FIG. 3(*b*). In a further modified embodiment illustrated in FIG. 4, restrained flow paths (18*a*) are repeatedly and alternately narrowed and broadened by bending sheet-like flow restraining elements (17*a*) in a wave form. However, in any case, the angle of divergence in the broadening region of the flow path is kept small so that vortexes cannot grow large.

The operation of the slice chambers according to the present invention may now be explained. In the raw paper liquid flowing through the restrained flow paths having the above-mentioned variations in cross-section acceleration and deceleration repeatedly and alternately arises along the direction of flow. When a flock is present in an acceleration region, since the flow velocity on the upstream side is lower and the flow velocity on the down stream side is higher, the flock is torn off under tension and dispersed. On the other hand, in a deceleration region, since the relation of the lower and higher flow velocities on the upstream and downstream sides is reversed, the flock is elongated under compression in the direction at right angles to the average traveling direction, that is, in the directions of width and thickness of the sliced liquid flow. By repeating such effects, flocks are finely divided and fibers can be uniformly dispersed in the raw paper liquid. While the dispersed fibers are directed in the average traveling direction in the acceleration region, in the deceleration region they are directed in random directions due to compressive forces from the rear.

In the embodiments shown in FIGS. 3(*a*) and 3(*b*), in the final stage of the restrained flow paths (18) the fibers travel towards the slice lip 11 as directed in random directions. However, in the embodiment shown in FIG. 4, the final portions of the restrained flow paths (18*a*) are formed so as to equally divide the whole flow path delimited by the top plate (12) and the bottom plate (15), and since restrained flow paths having acceleration regions in the just preceding portions and those having deceleration regions in the just preceding portions are alternately stacked, a whole raw paper liquid flow consisting of layers containing fibers directed in the averaged traveling direction and layers containing randomly directed fibers stacked alternately, is passed towards the slice lip (11).

In the case of either flow restraining elements (17) or (17*a*), some turbulence in a flow would be generated at the downstream end portion of slice chamber 16, and therefore, the raw paper liquid layers which have flowed through the respective restrained flow paths flow towards the slice lip (11) while the adjacent flow layers are being mixed at the boundary portions between adjacent layers.

Figure 5:
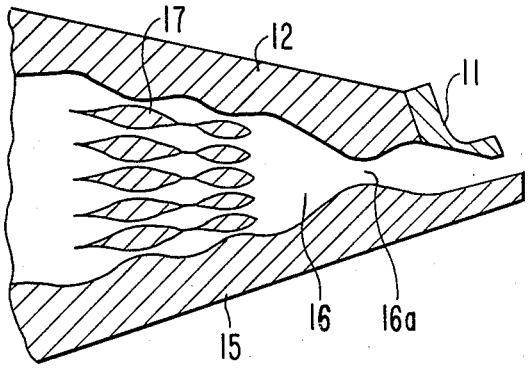

It is to be noted that according to the present invention, as seen in the above-described embodiments, a flow path having its cross-sectional area repeatedly, alternately and smoothly increased and decreased is provided. However, to that end, it is not always necessary to partition a flow path into a plurality of flow paths by means of flow restraining elements (17) or (17*a*) as shown in FIGS. 3(*a*), 3(*b*) or 4, but only one channel of flow path could be used. More particularly, in a modified embodiment shown in FIG. 5, on the upstream side, a plurality of partitioned flow paths are employed, and after the flow of raw paper liquid has been subjected to acceleration and deceleration alternately in the respective partitioned flow paths, the flow of raw paper liquid is passed through a united flow path portion just in front of the slice lip (11) at the downstream end, which united flow path portion also has its cross-sectional area repeatedly, alternately, gradually and smoothly increased and decreased as shown at (16*a*).

Figure 4:
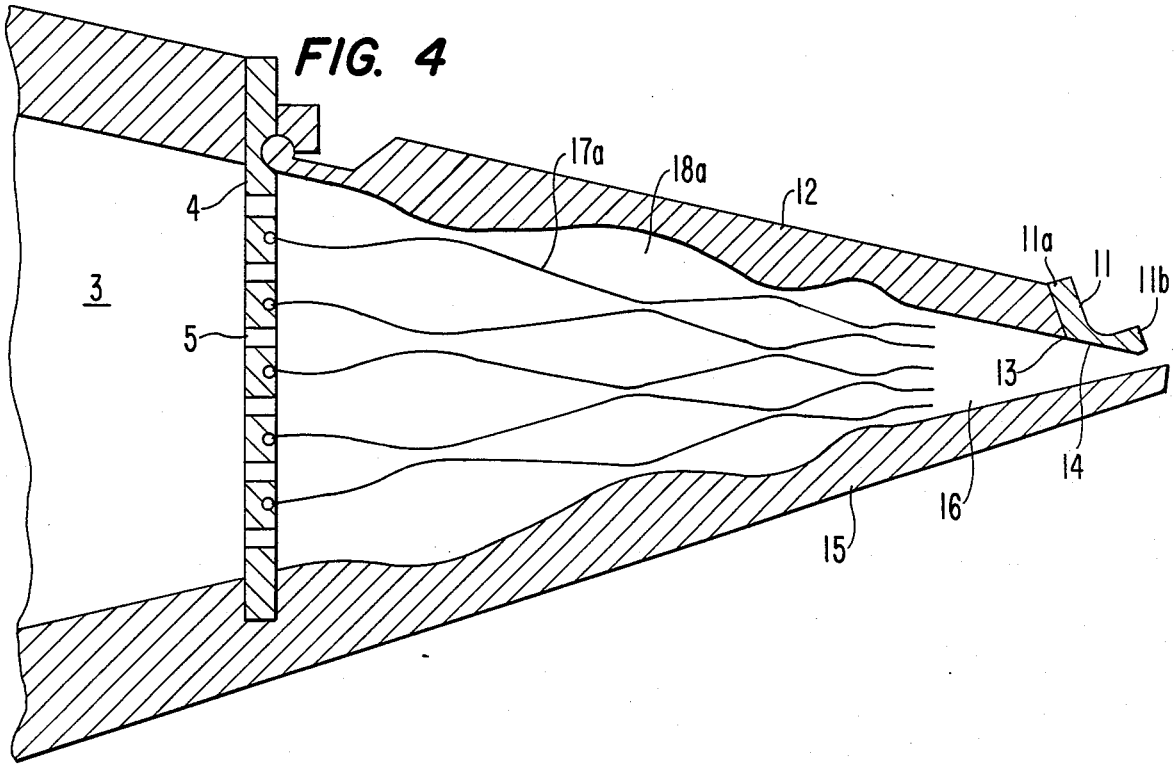
Figure 6:
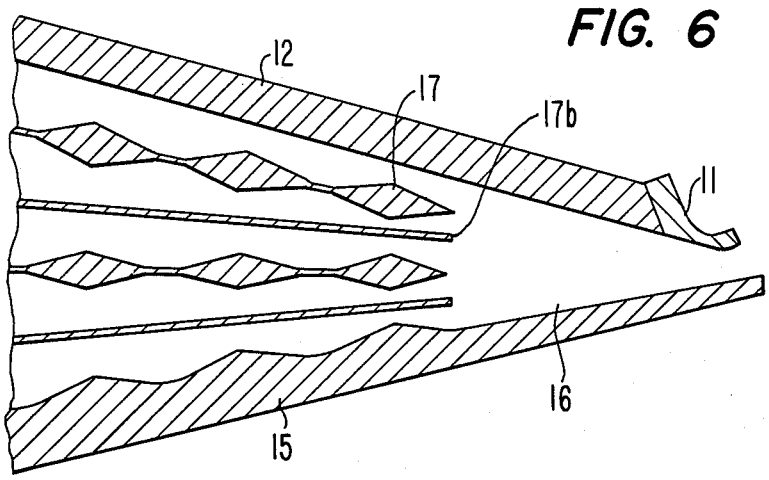
Figure 7:
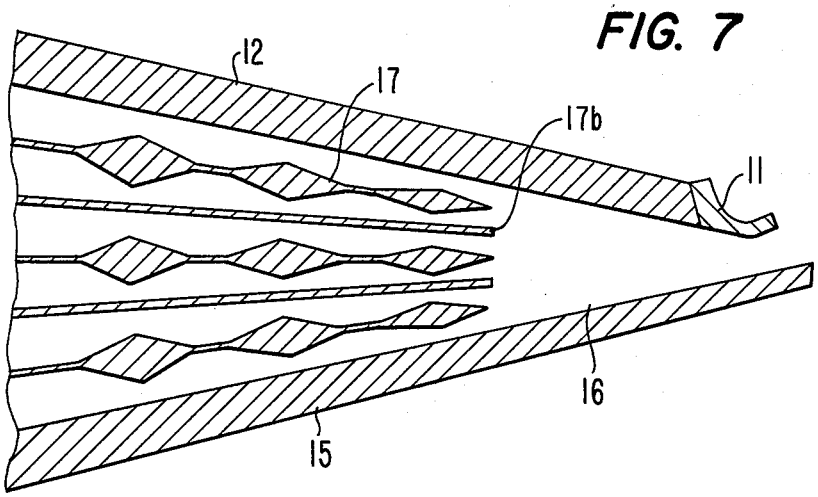

In addition, with regard to the flow restraining elements available upon dividing a flow path into a plurality of narrower paths, they need not be elements having a thickness varying along their length as shown at (17) in FIGS. 3(*a*) and 3(*b*) nor elements consisting of curved sheets as shown at (17*a*) in FIG. 4, but as shown in FIGS. 6 and 7 planar sheet-like elements (17*b*) can be used as flow restraining elements at alternate positions between the flow restraining elements (17) having a thickness varying along their length.

Figure 8:
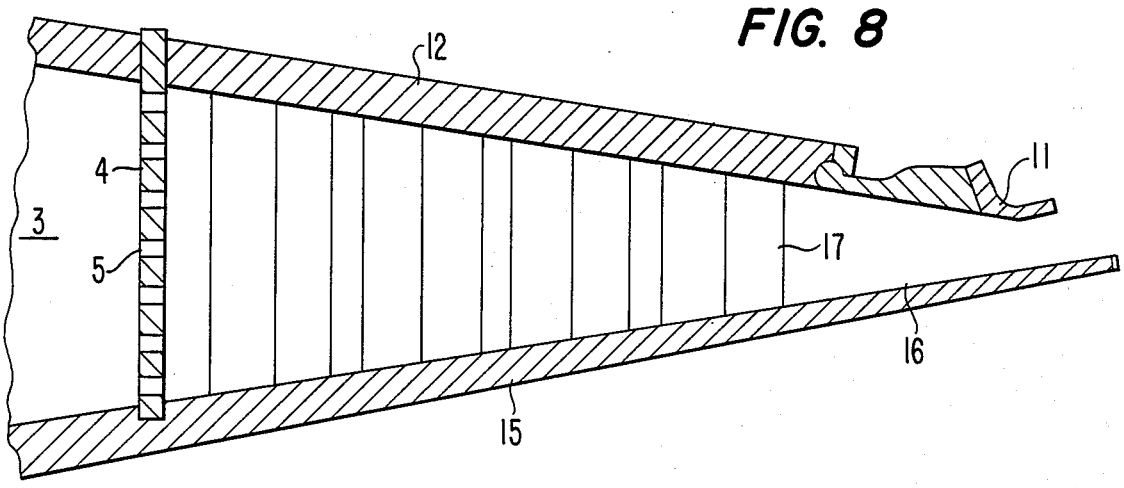
Figure 9:
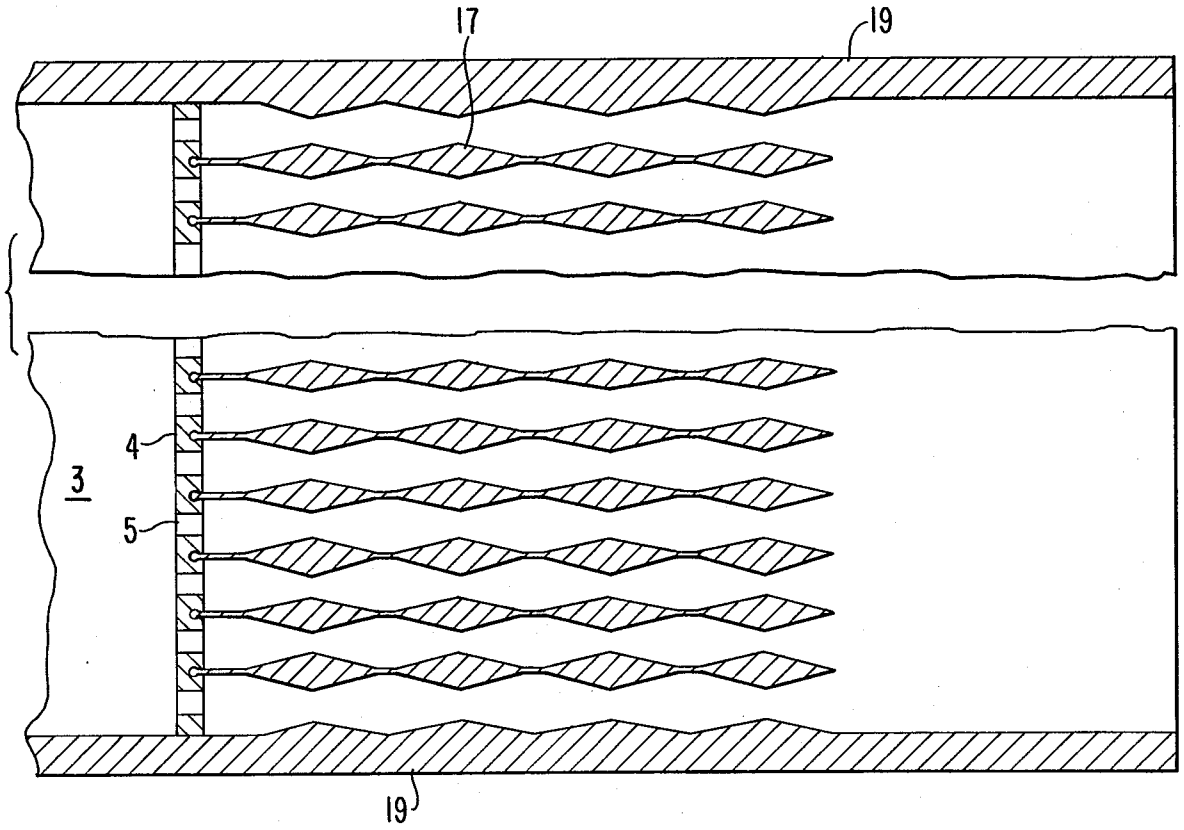
FIG. 9 is a longitudinal cross-section plan view of the head box shown in FIG. 8, and FIGS. 10 and 11 are longitudinal cross-section side views showing a different type of preferred embodiments of a head box in a paper machine according to the present invention, in which a slice chamber includes only a single flow path.

FIG. 6 shows the case where a flow path is divided into 3 or larger odd number of narrower flow paths, while FIG. 7 shows the case where a flow path is divided into 2 or larger even number of narrower flow paths, and in either case planar sheet-like flow restraining elements (17*b*) are used in combination with flow restraining elements (17) having a variable thickness. In addition, it is to be noted that upon partitioning a flow path into a plurality of narrower flow paths by means of flow restraining elements, either the flow path could be partitioned with respect to the direction of thickness of a paper web being produced as shown in FIGS. 3(*a*), 3(*b*), 4, 5, 6 and 7, or it could be partitioned with respect to the direction of width of a paper web being produced as shown in a longitudinal cross-section side view in FIG. 8 and in a longitudinal cross-section plan view in FIG. 9. Although FIGS. 8 and 9 illustrate the case where a flow path is partitioned by means of flow restraining elements (17) having a variable thickness, similar partitioning of a flow path could be achieved even by means of such flow restraining elements (17) and planar sheet-like flow restraining elements (17*b*) as shown in FIGS. 6 and 7 in combination, or by means of curved sheet-like flow restraining elements (17*a*) as shown in FIG. 4. In FIG. 9, reference numeral (19) designates side plates on the opposite sides of a slice chamber, and in FIGS. 3(*a*), 4, 8 and 9, reference numeral (3) designates a pre-slice chamber, numeral (4) designates a perforated plate, and numeral (5) designates perforations.

Since the head box according to the present invention is constructed as described above, if the head box includes a slice lip having such configuration that it would not cause turbulence of dispersed fiber raw material and would not impose strong acceleration, then either a raw material jet in which fibers are well dispersed and no directionality is found in the orientation of the fibers, or a jet having a laminated structure consisting of layers in which fibers are well dispersed and the orientations of the fibers are directed in the direction of outflow and layers in which fibers are randomly directed, can be obtained. Accordingly, after dehydration in a wire part, either a paper web in which fibers are well dispersed and in which a difference in properties between the longitudinal and lateral directions is small, or a paper web in which fibers are well dispersed and which has a laminated structure such as veneers, can be obtained.

Figure 10:
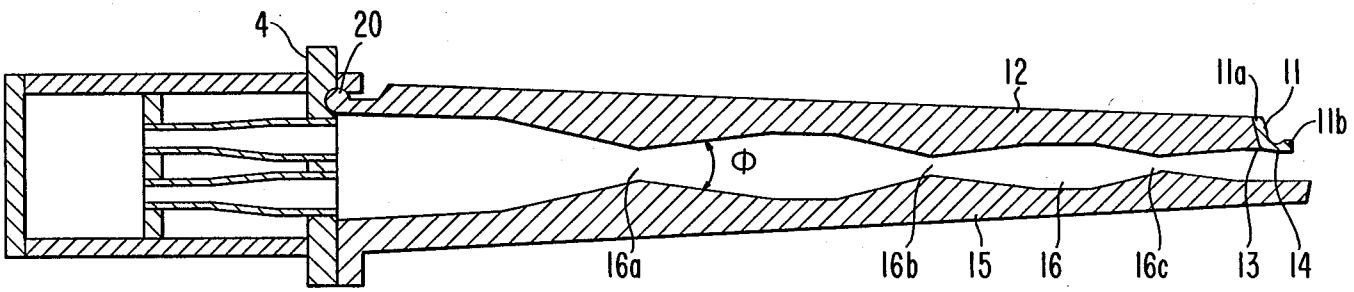

Another preferred embodiment of the present invention is illustrated in FIG. 10. In this figure, reference numeral (11) designates a slice lip, which is fixedly secured to a top plate (12) by means of bolts not shown, and the junction (13) between the slice lip (11) and the top plate (12) on the side of contacting a liquid is formed in a flush face. The slice lip (11) includes a neck portion (14) having a low rigidity as disclosed in the copending Japanese patent application No. 55-28722 filed by the same applicant as this application, between its mounting portion **(11*a*) to be fixed to the top plate (12) and its tip end portion (11*b*). The slice lip (11) is adapted to be flexed at the neck portion (14) by manipulating a jacking rod (not shown) which is mounted to the tip end portion (11*b*) so as to broaden or narrow the gap distance between the tip end portion (11*b*) of the slice lip (11) and a bottom plate (15)**, and thereby a lip opening is varied to change the flow rate at respective points along the widthwise direction of the slice lip opening for achieving fine adjustment of a profile of basic weight along the widthwise direction.

In addition, the top plate (12) can be rotated about a fulcrum (20) with respect to a perforated plate (4) by manipulating a jacking rod not shown, and thereby the gap distance between the slice lip tip end portion **(11*b*) and the bottom plate (15) can be adjusted. Reference numeral (16) designates a flow path delimited by the top plate (12) and the bottom plate (15) converging towards the slice lip (11), and as shown in FIG. 10, a cross-sectional area of the flow path (16) bounded by the top plate (12) and the bottom plate (15) is smoothly and gradually varied. More particularly, by providing throat portions (16*a*), (16*b*) and (16*c*) along the flow path (16), the flow path (16) is repeatedly and alternately narrowed and broadened as the restraining faces 30 and 31 of top plate 12 and bolt on plate 15 successively extend toward the slice lip on opposite sides of the flow path while approaching and separating from opposing faces on the other side of the flow path. The angle of divergence $\phi$ in the broadening regions of the flow path (16) as indicated in FIG. 10** is limited to 25° or less, and thereby broadening is effected gradually.

Explaining now the operation of the head box illustrated in FIG. 10, owing to the variation of the cross-sectional area of the flow path (16), acceleration and deceleration would occur in the raw paper liquid flow flowing through the flow path (16). When a flock is present in an acceleration region, since the flow velocity on the upstream side is lower and the flow velocity on the downstream side is higher, the flock would be torn off under tension and would be dispersed. Whereas, in a deceleration region, since the relation of the lower and higher flow velocities on the upstream and downstream sides is reversed, the flock is elongated in the direction at right angles to the average traveling direction, that is, in the direction of width and thickness of the paper web being produced, under compression.

By repeating such effects, flocks are finely divided and fibers can be uniformly dispersed in the raw paper liquid. While the dispersed fibers are directed in the average traveling direction in the acceleration region, in the deceleration region they are directed in random directions because fibers are pushed from the back side.

When it is desired to obtain a paper web in which orientations of fibers are aligned in the direction of outflow, it can be achieved generally be selecting the angle of convergence in the narrowing regions larger than the angle of divergence, whereas when it is desired to obtain a paper web in which no directionality is found in the orientations of fibers, it can be achieved by selecting the angle of convergence equal to the angle of divergence.

Owing to the repeated smooth narrowing and broadening of the flow path and the selection of the angle of divergence as described above, vortexes would not be generated in the flow of a raw paper liquid, and hence it would not occur that fibers are moved outwardly by centrifugal forces caused by vortexes and to thereby cause a difference in concentration of fibers in the flow of a raw paper liquid. Therefore, dispersed fibers would not flock again. In the flow path (16) shown in FIG. 10 are provided a plurality of throats **(16*a*), (16*b*) and (16*c*), so that as a result of choking resistances at these throats, a raw paper liquid flow having a small velocity variation and a small flow direction error along the widthwise direction can be obtained. (This is also the same in the case illustrated in FIG. 11** as explained below).

According to the present invention, if a raw paper liquid in which fibers is uniformly dispersed by means of the flow path (16) shaped so as to have nearly equal narrowing taper angle and broadening taper angle, is used in combination with a slice lip (11) having a shape adapted not to cause turbulence and not to apply acceleration or a shape adapted not to apply strong acceleration as shown in FIG. 10, then a jet in which fibers are well dispersed and no directionality is found in the orientations of the fibers, can be obtained.

Figure 11:
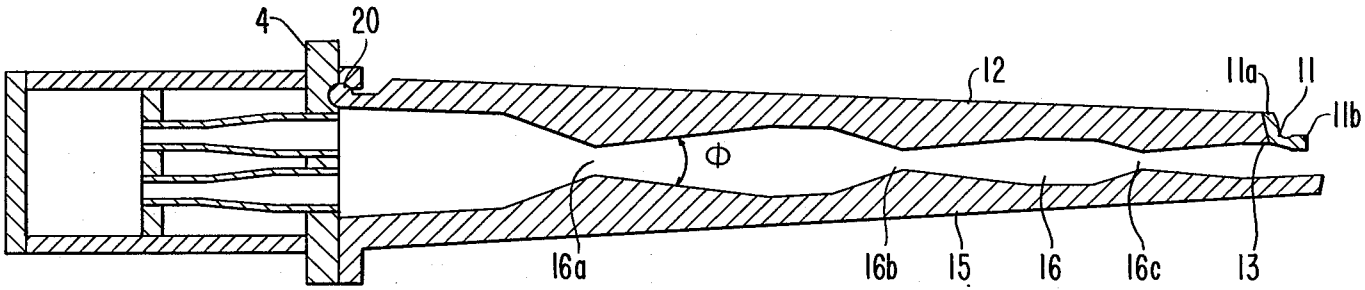

On the other hand, if a raw paper liquid in which fibers are uniformly dispersed by means of the flow path (22) shaped so as to have a larger angle of convergence and a smaller angle of divergence, is used in combination with a slice lip (11) having a shape adapted to apply acceleration as shown in FIG. 11, then a jet in which fibers are well dispersed and the orientations of the fibers are aligned in the direction of outflow, can be obtained.

Accordingly, if a paper web is made by dehydrating the above-mentioned jet of raw paper liquid in the subsequent wire part, then a paper web in which dispersion of fibers is excellent and mechanical properties in the longitudinal direction and in the lateral direction have little variation, or a paper web in which dispersion of fibers is excellent and a strong mechanical property is presented in the longitudinal direction, can be obtained. In FIG. 11, component parts equivalent to those used in the preceding embodiments are given like reference numerals.

Furthermore, according to the present invention, since dispersion of fibers is excellent, a paper web can be made of a raw paper liquid having a higher concentration than the conventional raw paper liquid concentration of 0.3% to 0.8% accordingly, the amount of use of water is reduced, capacities of feed pumps and the like can be reduced, and therefore, the running cost of paper making can be lowered. Moreover, since a raw paper liquid flow having a small flow velocity variation and a small velocity direction error along the widthwise direction can be obtained, the profile of the manufactured paper web along the widthwise direction is also improved.

What is claimed is:

1. A head box in a paper machine, comprising:

(1) a slice lip;

(2) a slice chamber delimited by a top plate and a bottom plate converging to said slice lip; and (3) means, defining a plurality of partitioned flow paths inside said slice chamber upstream of said slice lip, including flow paths immediately adjacent said top and bottom plates, each of said plurality of flow paths having a varying cross-sectional area and having a plurality of alternating acceleration regions and deceleration regions, for repeatedly alternately accelerating and decelerating a raw paper liquid along said flow paths toward said slice lip in order to respectively repeatedly alternately stretch any fiber flocks in said liquid in the direction of flow by application of a tension force thereto in said acceleration regions and extend said any fiber flocks in directions perpendicular to said direction of flow by application of a compression force thereto in said deceleration regions, whereby the fibers in said any fiber flocks are dispersed;

a perforated plate at the upstream end of said slice chamber extending vertically between said top plate and said bottom plate;

a plurality of flow restraining elements extending from said perforated plate toward said slice top and vertically spaced apart inside said chamber to form flow paths between said top and bottom plates which extend widthwise of said headbox, said flow restraining elements having faces which repeatedly, alternately and gradually approach and separate from opposing faces of adjacent ones of said flow restraining elements along said direction of flow so as to substantially linearly repeatedly increase and decrease the dimensions of said cross-sectional area of each of said flow paths along said direction of flow, said faces separating from opposing faces of adjacent ones of said flow restraining elements along said direction of flow in said deceleration regions at an angle of divergence between opposing faces in said deceleration region along said flow paths no greater than 25°, said faces converging toward opposing ones of said faces along said direction of flow in said acceleration regions at an angle of convergence between opposing faces in said acceleration regions which is substantially equal to said angle of divergence;

said top and bottom plates and said flow restraining elements each having flat surfaces extending in the downstream direction from said perforated plate to the start of the increasing and decreasing cross-sectional area flow paths, said flat surfaces defining between them small chambers between said perforated plate and the upstream ends of the increasing and decreasing cross-sectional area flow paths, said perforated plate having the perforations opening into said small chambers; and said flow restraining elements terminating upstream of said slice lip, said top plate and said bottom plate having facing surfaces downstream of said flow restraining elements which approach and separate from each other while converging toward said slice lip, said facing surfaces being so shaped between said facing surfaces downstream of said flow restraining elements as to define a throttle whose cross-sectional area gradually and smoothly increases and decreases toward said slice lip.

* * * * *